United States Patent [19]

Gushurst, Jr.

[11] 4,388,888

[45] Jun. 21, 1983

[54] ADJUSTABLE AIRFOIL

[76] Inventor: Fred W. Gushurst, Jr., 6117 E. Otero Pl., Englewood, Colo. 80112

[21] Appl. No.: 257,385

[22] Filed: Apr. 24, 1981

[51] Int. Cl.[3] ..... B63H 9/06; B63H 9/08; B63H 9/10

[52] U.S. Cl. ..... 114/90; 114/95; 114/103; 114/104

[58] Field of Search ..... 114/39, 102–105, 114/89–97

[56] References Cited

U.S. PATENT DOCUMENTS

| | | | |
|---|---|---|---|
| 1,408,868 | 3/1922 | Dutcher | 114/90 |
| 1,613,890 | 1/1927 | Herreshoff | 114/39 |
| 1,700,660 | 1/1929 | Williams | 114/90 |
| 3,132,620 | 5/1964 | Court | 114/102 |
| 3,580,203 | 5/1971 | Martin | 114/39 |
| 3,802,366 | 4/1974 | Mankawach | 114/39 |
| 4,263,861 | 4/1981 | Vicard | 114/90 |
| 4,341,176 | 7/1982 | Orrison | 114/102 |

FOREIGN PATENT DOCUMENTS

| | | | |
|---|---|---|---|
| 358143 | 4/1938 | Italy | 114/104 |
| 55-47993 | 5/1980 | Japan | 114/104 |
| 568209 | 3/1945 | United Kingdom | 114/103 |

*Primary Examiner*—Trygve M. Blix
*Assistant Examiner*—Thomas J. Brahan

[57] ABSTRACT

This invention relates to an adjustable airfoil which in one embodiment includes a pivotal mast having laterally extending spaced upper and lower arms. Between the arms is a vane which is rotatably mounted on the mast and has a luff slot at its aft end for receiving the forward end of spaced battens connected to flexible sail panels. The panels are provided with inserts at their forward ends sewed in such a manner as to cause the panels to fold in accordion fashion when they are lowered. The sail is raised and lowered by a halyard which may be either in the form of an endless loop mounted adjacent a positioning cable extending between the aft ends of the arms or it may extend forwardly and down through the mast and back to a control station, such as the helm of a sailboat. Contouring arms are pivoted between the aft end of the vane and travelers moveable along tracks mounted in the upper and lower arms for increasing or decreasing the contour of the airfoil so as to be able to form a configuration similar to a spinnaker when sailing before the wind. In one embodiment, luff flaps extend between the vane and the forward end of the sail panels to form a smooth contoured surface on the airfoil at this position for smooth laminar airflow. In another embodiment, a double luff slot arrangement in the vane includes a forward luff slot to receive the ends of battens between the panels and an aft luff slot to receive the luff edge of the sail panels. A plurality of spaced shackles contour the sail panels to change the contour of the airfoil to fit different sailing conditions.

21 Claims, 37 Drawing Figures

ADJUSTABLE AIRFOIL

TECHNICAL FIELD

This invention relates to an adjustable airfoil, and more particularly to an airfoil which has particular use on a boat and can rotate through 360° and be controlled from the helm.

BACKGROUND ART

Many attempts have been made to provide rigid or substantially rigid airfoils on boats. Among these are U.S. Pat. No. 1,408,868 to Dutcher; U.S. Pat. No. 1,613,890 to Herreshoff; U.S. Pat. No. 3,580,203 to Martin; U.S. Pat. No. 1,700,660 to Williams; and U.S. Pat. No. 3,802,366 to Mankawach. However, in each instance these airfoils are quite complex and therefore, very expensive and have not found practical application on sailing vessels.

As the cost of energy becomes more critical, the need for airfoils which can be used on boats for carrying cargo, as well as on pleasure craft, is increasingly recognized. Therefore, in order to meet this need, it is necessary to provide airfoils which have smooth surfaces to provide laminar airflow and therefore, greater lift. Furthermore, such sails must be adjustable in their contour for different sailing conditions, i.e., depending whether the ship is sailing upwind or downwind. Furthermore, the sail must be rigged so that it can be easily lowered should an unexpected storm arise and means must be provided for reducing air resistance to the minimum around the mast and rigging. Also, it is desirable to have a structure which can be used as a storm sail in severe weather. An ideal is to construct a wind engine that can capture wind energy (from whatever direction) and convert it to propulsive force in the direction wanted—all by remote control.

DISCLOSURE OF INVENTION

An adjustable airfoil for a sailboat is provided in one embodiment wherein the mast is rotatable and includes a pair of vertically spaced arms between which a vane is mounted for rotation independently of the arms and mast. A plurality of articulated, flexible panels form the sail and each panel has means slidably received in a luff slot in the vane. Halyard means is provided to raise and lower the sail. The panels are folded in accordian fashion when the sail is down and, when raised, form a unitary planar surface, and are mounted for lateral motion upon rotation of the vane to form an airfoil which may be adjusted in curvature for different sailing conditions. Conveniently, the space between the luff slot and the sail is covered by a flap which extends vertically along the vane and has a cutout at its lower end to permit the folding of the sail panels in accordian fashion when they are lowered. In one embodiment, a positioning cable can serve as a halyard for raising and lowering the sail wherein the upper panel is fixedly connected to the halyard line and the bottom of the sail is held by the lower arm.

More specifically, the airfoil construction includes a plurality of generally horizontal, vertically-spaced battens, each having an enlarged forward end slidably received in the luff slot. The sail panels are interconnected by the battens and include pockets formed at the leading edge to receive inserts sewn in the pockets by stitching to form folds which cause the panels to fold in accordion fashion when the sail is lowered.

An upper and lower contouring arm each have one end pivotally connected to opposite ends of the aft edge of the vane. The opposite end of each arm is pivoted to a traveler which is movable longitudinally along the respective upper and lower mast arms. By adjusting the position of the traveler, the shape of the airfoil may be altered for different sailing conditions. Thus, by moving the travelers forward, the contour of the airfoil may be made similar to a spinnaker for sailing down wind or on a broad reach.

The sail is also held, further aft, by the vertical cable extending from the arm in such a way that when the vane rotates to one side, moving the luff edge of the sail with it, the cable holds the battens and acts as a pivot, so that the leech of the sail moves opposite the luff. Thus, when the sail fills with wind, it will automatically contour itself (unless prevented by the controls) so as to form a near perfect airfoil, which can be further trimmed by the controls to suit different strengths of wind. That is, on either tack, the vane will tend to rotate from pressure of the wind to that certain angle at which the curve of its lee surface smoothly joins the straight line of the sail proper, so that the wind moves across the entire lee surface of the airfoil with minimum turbulance.

In an alternative embodiment, the forward part of the airfoil also is composed of a rigid streamlined vane which runs the length of the mast and is able to rotate about the mast. A single arm extends from and is fixed to the upper end of the mast and is rotatable with the mast independently of the vane. The vane has a double luff slot which holds a sail with several battens, the inner luff slot holding the ends of the battens and the outer slot holding the luff edge of the sail.

A contouring mechanism can force the vane to rotate beyond the angle of rotation provided by the luff slot. But, if forced beyond this angle, the battens will bind in the luff slot and further rotation will cause the battens to bend into a curve. Thus, with this greater arch, better suited to light winds, the lee curve of the vane is continued for a distance aft in the curve of the battens and sail, until it again smoothly becomes a straight line farther aft. If the vane is rotated to a wide angle, the batten curve is increased to such a degree that the airfoil has become an air scoop, similar to a spinnaker.

The battens and sail can move freely up and down on the cable, and slide in the luff slots, so that as the halyard is slackened, the sail will drop. The exterior luff slot which holds the luff of the sail is cut away on one side near the bottom of the vane so that when the sail is lowered, folds out in sections to form a pile on one side, while the battens, their ends still held in the inner slot, stack one upon the other.

When the sail is fully reefed with either embodiment, the vane, itself an excellent airfoil, remains as an effective storm sail, fully maneuverable by rotating the mast. In violent weather, the controls are released so that the vane will "feather" itself and the rig will present a single streamlined pole to the wind.

With this wind engine a pilot can move his vessel forward or backward, or turn it on the spot. He can engage his engine fully to the wind, or partially, or disengage it almost entirely, knowing that at all times his rig is firmly secured. Given wind, he can maneuver almost as easily as he could in a power boat, and his energy is free. Other significant advantages are that the mast and vane can be used to gather solar energy to heat the cabin of the boat, if that is desired, and if his vessel is capsized by violent seas, it will immediately tend to right itself.

Additional advantages of this invention will be apparent from the description which follows taken in conjunction with the accompanying drawings.

BEST MODE FOR CARRYING OUT THE INVENTION

Figure 1:
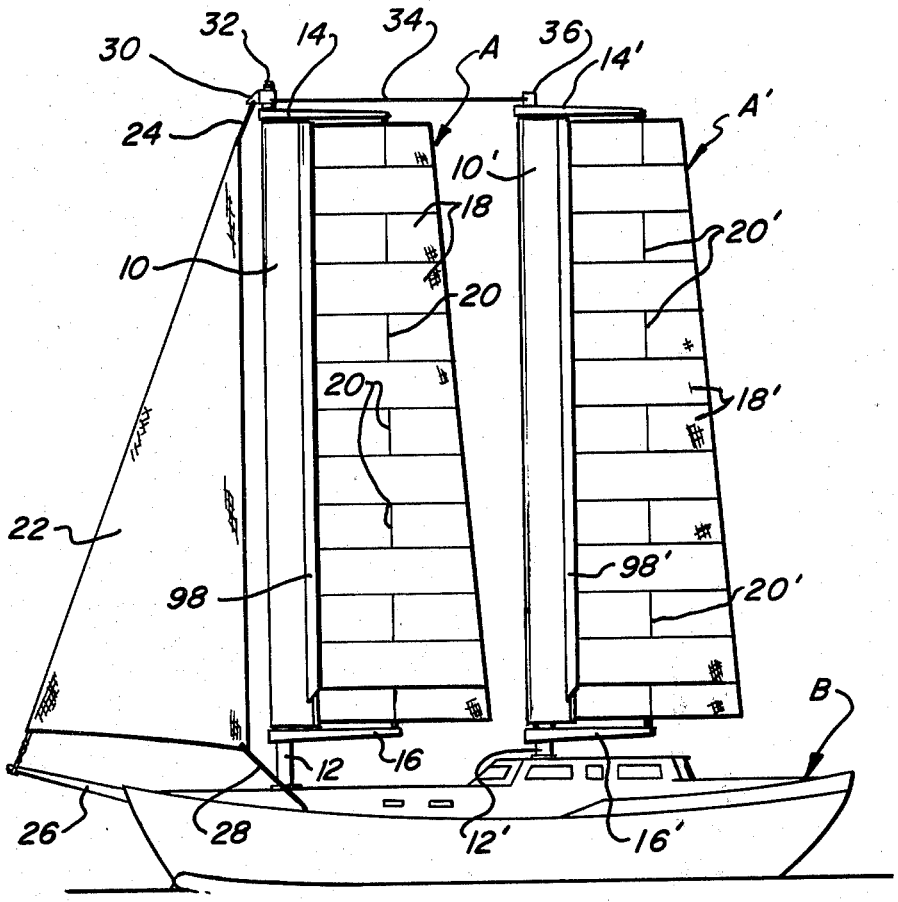
FIG. 1 is a side elevation of a boat having airfoils or sails constructed in accordance with one form of this invention.
Figure 2:
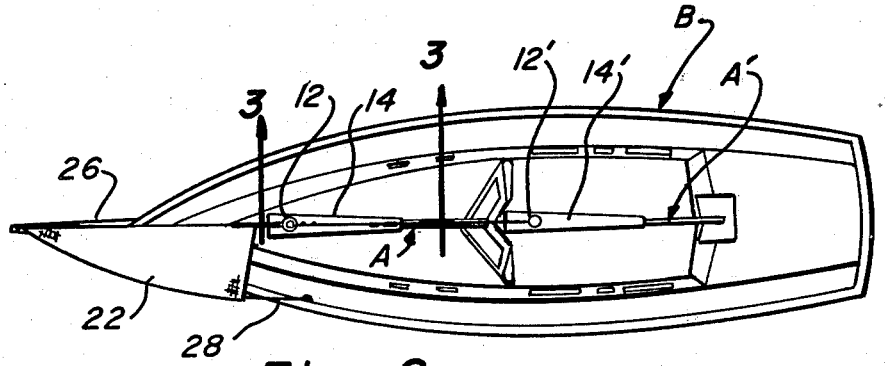
FIG. 2 is a top plan view of the boat of FIG. 1.

As best seen in FIG. 1, a boat B is illustrated which is provided with a pair of airfoils A and A′ to provide novel sails for full control and maneuverability of the boat.

Figures 3, 4:
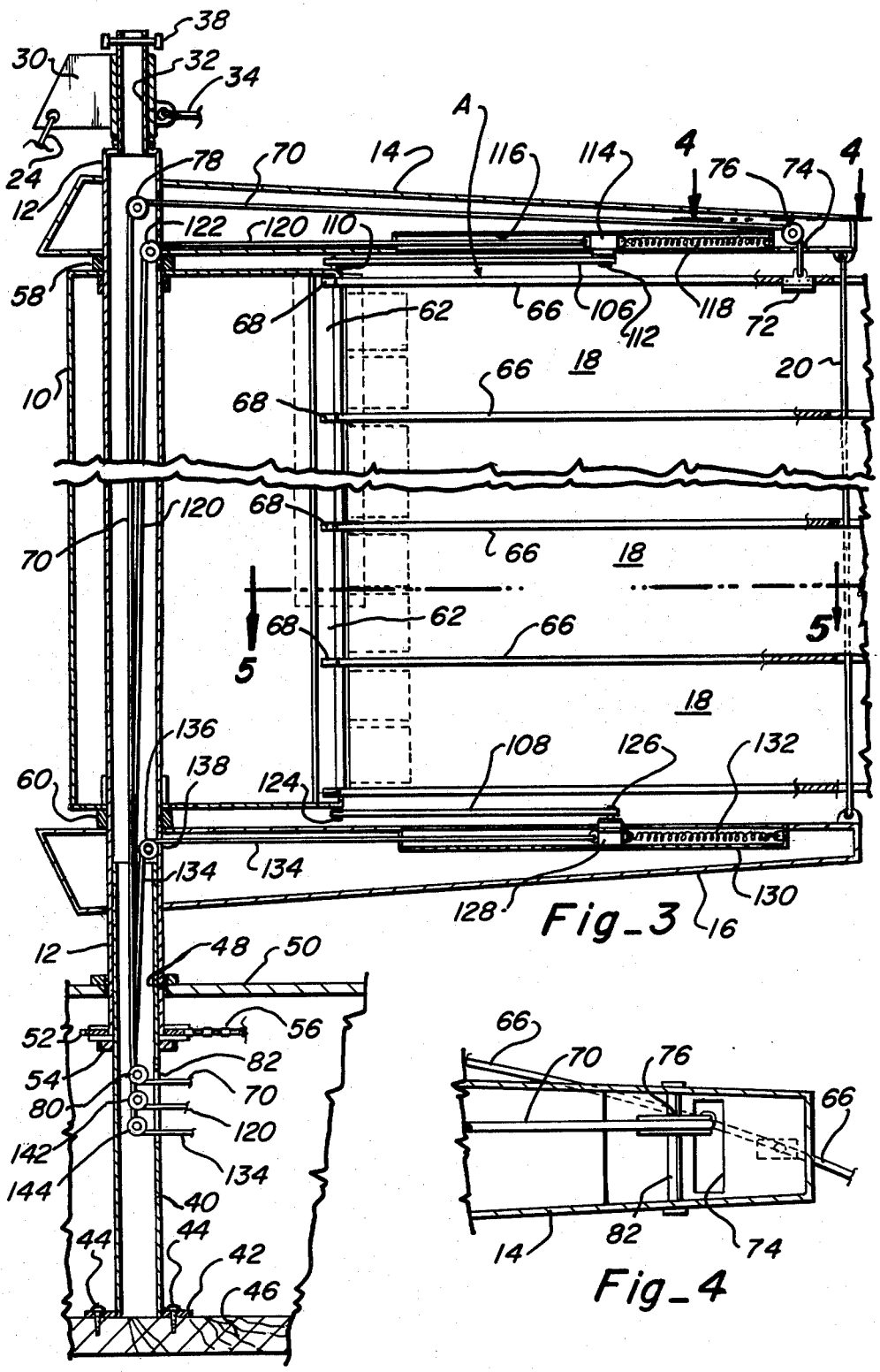
FIG. 3 is an enlarged vertical section, taken along line 3—3 of FIG. 2, through the forward mast and airfoil showing details of the construction thereof.
FIG. 4 is an enlarged horizontal section, taken along line 44 of FIG. 3, showing the guide means for the halyard.

Each airfoil includes a vane 10 and 10′ respectively mounted on masts 12 and 12′. The forward mast 12 is mounted on the foredeck whereas the mizzenmast is mounted on the cabin deck. A pair of laterally extending arms such as upper arms 14 and 14′ and lower arms 16 and 16′ extend from the respective masts as shown. The airfoils include a plurality of sail panels 18 and 18′ which are vertically slideable in a luff slot in the aft edge of vanes 10 and 10′ as will be more fully described below. A positioning cable 20 and 20′ respectively extends between upper and lower arms 14 and 16 and 14′ and 16′, and is located closer to the leech edge of the sail panels than to the luff edge, as shown. A jib 22 is mounted on a forestay 24 extending from the upper end of forward mast 12 to a bow sprit 26 and is controlled by means of a sheet 28. Conveniently, the upper end of forestay 24 is fastened to a support 30 which is journaled, as best seen in FIG. 3, on a post 32 extending from the upper end of mast 12. A horizontal stay 34 extends from support 30 to a post 36 on the upper end of mizzenmast 12′ to provide support for this mast. If desired, the jib 22 can be roller reefed on forestay 24 in which case suitable swivels and a reefing roller would be provided, as is well understood in the art. A pin 38 extends through the upper end of post 32 to prevent support 30 from coming off the top of the post.

From FIG. 3, it will be apparent that the mast 12 is rotatably mounted on a mast axle 40 which has a lower flange 42 through which fastening means, such as bolts 44, extend into hull 46 of the boat. The mast axle extends upwardly through an opening 48 in deck 50 to a position well above the top of the deck, as shown. Mast 12 is provided at its lower end with a gear wheel 52 integrally formed therewith which rests on a support ring 54 attached to mast axle 40, as by welding. The mast is rotated by means of a chain drive 56 which extends rearwardly to a drive motor or winch (not shown) at the helm. As previously stated, upper and lower arms 14 and 16 are fixedly attached to mast 12, as by welding, and intermediate them, vane 10 is rotatably mounted on the mast and is supported between an upper bushing 58 and a lower bushing 60. Although vane 10 is free to rotate on mast 12, its movement will be controlled to a large degree by the pivotal rotation of arms 14 and 16 when mast 12 is rotated and by the impact of the wind on the airfoil A, all as more fully described below.

Figure 5:
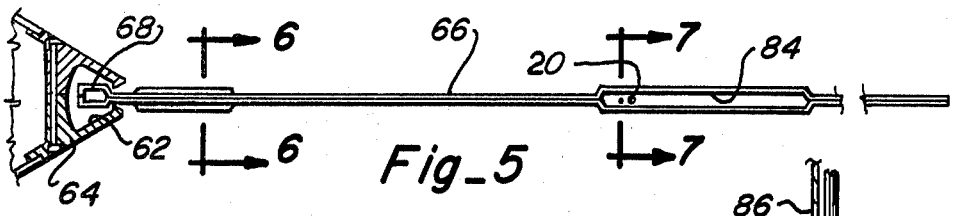
FIG. 5 is a horizontal section, taken along line 55 of FIG. 3, showing the construction of the battens used on the airfoil and the manner in which they fasten to the vane.
Figure 8:
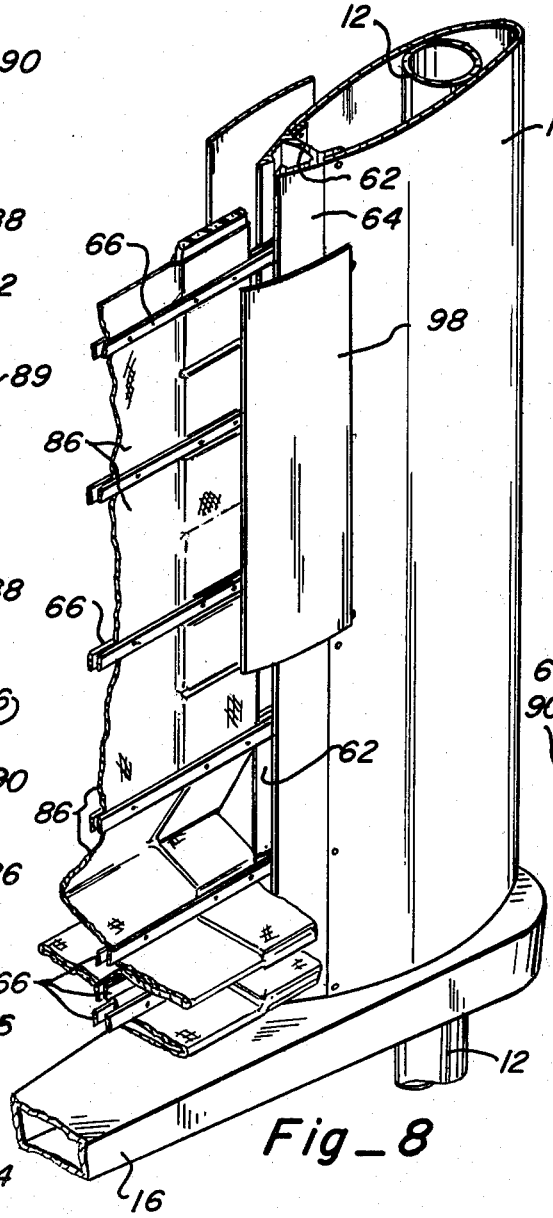
FIG. 8 is a fragmentary enlarged perspective view of a portion of the mast and airfoil showing the manner in which the said panels are folded in accordion fashion when the sail is lowered.
Figure 7:
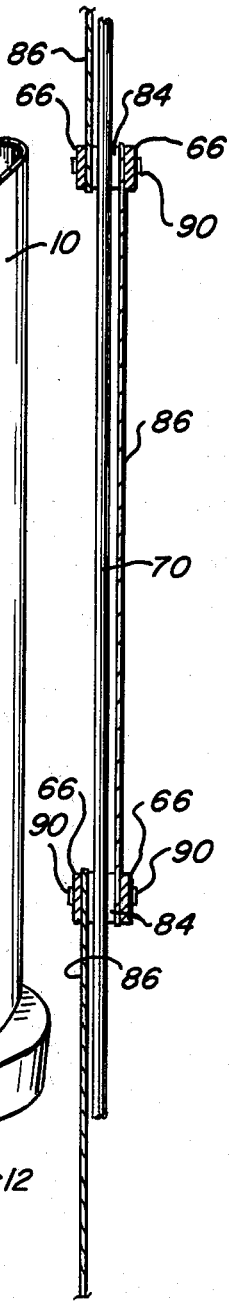
FIG. 7 is an enlarged vertical section, taken along line 7—7 of FIG. 5 showing the halyard line extending between opposed batten sections.

The aft edge of vane 10 is provided with a luff slot 62 running the full length thereof which may be formed as part of an extrusion 64, best seen in FIGS. 5 and 8. A plurality of battens 66 interconnect the sail panels 18, as best seen in FIG. 3, and have enlarged forward ends 68 which are slidable along luff slot 62 when the sail panels are raised and lowered by halyard 70. The first end 72 of the halyard is connected to the uppermost batten 66 adjacent positioning cable 20. The halyard then extends through an opening 74 in the bottom of arm 14 and around a sheave or pulley 76 located adjacent the aft end of arm 14. The halyard then extends forwardly to a second sheave or pulley 78 within mast 12 and then downwardly and around a bottom sheave or pulley 80 in the mast axle 40 and finally through an opening 82 in the axle where it can extend to a suitable winch or motor (not shown) at the helm for controlling raising and lowering the sail panels.

Conveniently, opening 74 in mast arm 14 is a generally elongated rectangular slot as best seen in FIG. 4 and pulley 76 is mounted for sliding movement along a shaft 82 extending between the sides of arm 14, as best seen in FIG. 4. The purpose of this arrangement is to allow the airfoil to move toward the leeward side of the arm and to form a more perfect airfoil configuration, i.e., one having a smooth undistorted surface for good laminar airflow therealong.

As seen in FIG. 5, battens 66 are formed of two complimentary halves which are offset toward the aft end to provide an elongated opening 84 to allow longitudinal movement of the battens and sail with respect to the positioning cable 20.

Figure 6:
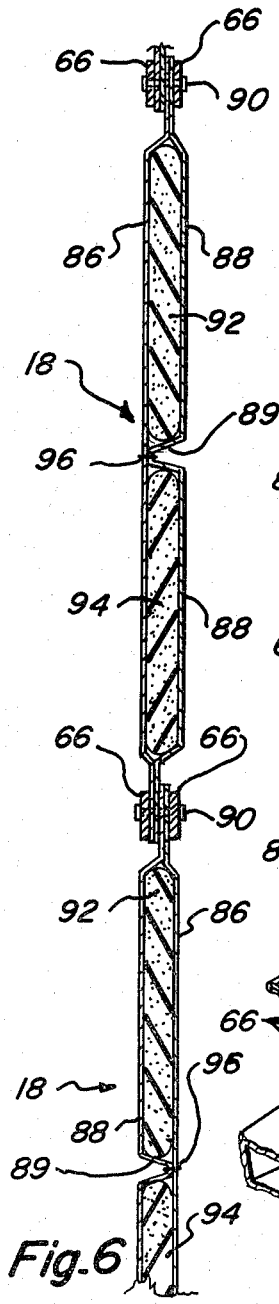
FIG. 6 is an enlarged vertical section, taken along line 6—6 of FIG. 5 showing pockets formed in the sail with foam pads secured therein for folding the said panels in accordion fashion when the sail is lowered.

As shown in FIG. 6, each sail panel 18 comprises a layer 86 which may be made of sail cloth or other suitable material and has a pair of pockets 88 formed at the forward edges. Each sail panel is secured between the halves of batten 66 by means of pins or rivots 90. Conveniently, adjacent the forward end of the sail panels, but just aft of the luff slot, vertically spaced inserts 92 and 94 are supported in pockets 88. These inserts are advantageously made of lightweight material, such as styrofoam or polyurethane. The set of inserts in one panel are separated by a fold 89 between the bottom of insert 92 and the top of insert 94 and connected to layer 86 as by stitching 96. Thus, when the said panels are lowered by means of halyard 70, they will tend to fold along stitching 96 as indicated by the arrows. On the other hand, in the next lower sail panel 18, pockets 88 are provided on the opposite side of layer 86 and a fold 98 is provided between upper insert 92 and lower insert 94 is the opposite of fold 89 and 94 which is connected to layer 88, as by stitching 96, so that when the said panels are lowered, this sail panel will fold in the opposite direction as indicated by the arrows. Thus, the inserts and pocket structure form hinged members so that the sail will fold in accordion fashion, as best seen in FIG. 8, for storage on the upper surface of lower arm 16.

In order to insure a smooth airfoil surface between the edge of the luff slot and the sail panels 86, a luff slot flap 98 is provided which is attached to vane 10 and extends in an aft direction across the leading edge of the sail panels as best seen in FIGS. 1 and 8. Conveniently, the luff flap terminates above lower arm 16 a sufficient distance to form a gap through which the sail panels may be folded in accordion fashion, as illustrated in FIG. 8.

Figure 11:
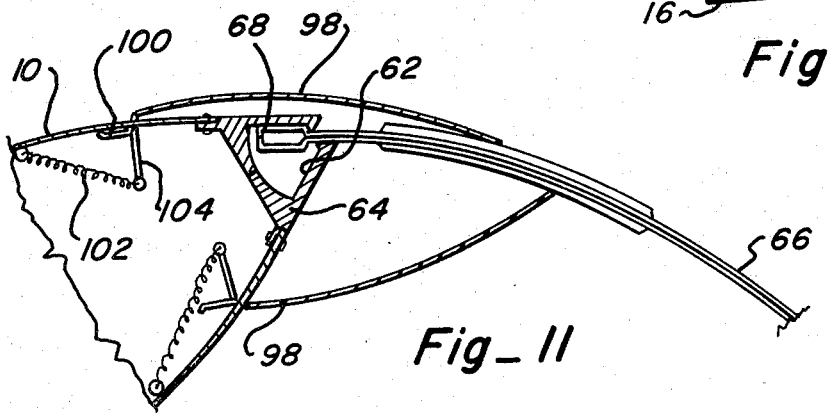
FIG. 11 is an enlarged horizontal section through a portion of the mast and airfoil showing the luff slot flap construction which provides a smooth continuous airfoil at the juncture of the luff slot and the sail panels.

As best seen in FIG. 11, each luff slot flap 98 terminates at its forward end in an offset foot 100 which normally bears against the inside edge of vane 10 and is held in that position by a spring 102 having one end attached to the inside of vane 10 and the other end attached to an arm 104 extending inwardly from flap 98, as shown. Thus, when the airfoil is curved at an angle with respect to the luff slot, as shown in FIG. 11, the flap 98 on the windward side will be forced outwardly as shown, whereas the flap on the leeward side will rest against the edge of the sail panels and battens 66. Obviously, when vane 10 turns in the opposite direction and the wind is from the opposite side, the position of the flaps will reverse. Thus, at all times, the gap which would exist between the luff slot 62 and the sail panels 18 is covered by the flap 98 which forms a continuous smooth surface to enhance laminar airflow and therefore, the lift provided by the airfoil structure.

Figure 9:
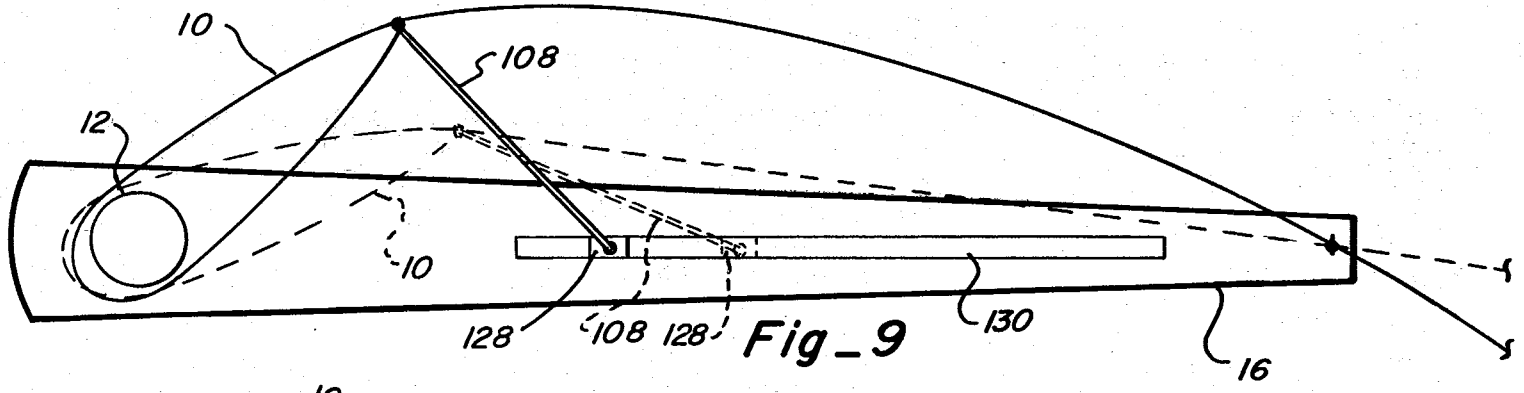
FIG. 9 is a diagrammatical top plan view showing how the contouring arms can be moved to change the contour of the airfoil.
Figure 10:
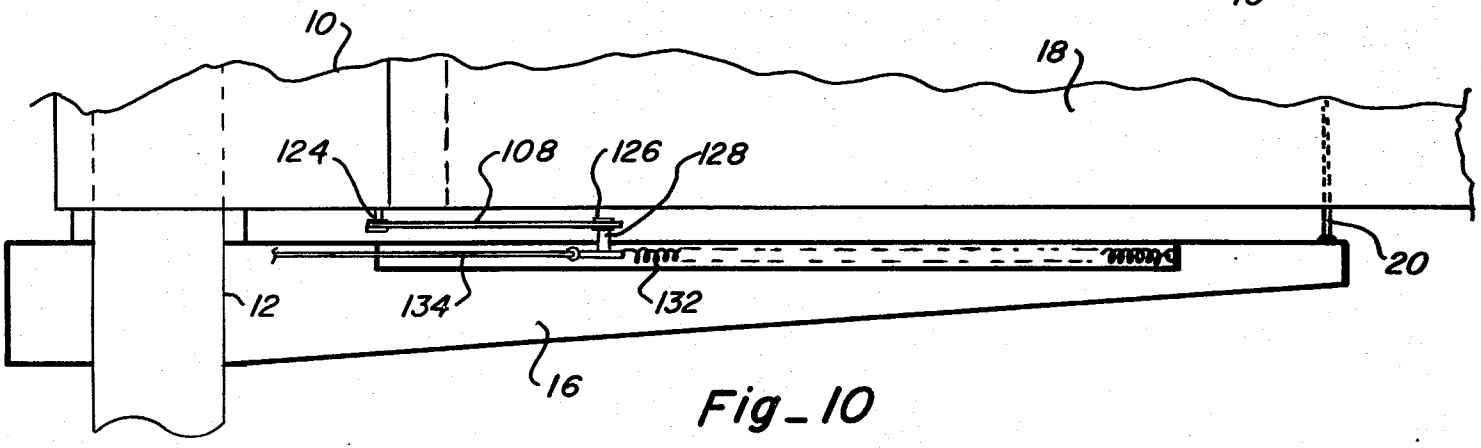
FIG. 10 is a diagrammatical side elevation of the airfoil of FIG. 9 showing the traveler arrangement for moving a contouring arm.

Referring to FIGS. 3, 9 and 10, it can be seen that the contour of the airfoil A can be adjusted by changing the position of upper contouring arm 106 and lower contouring arm 108. Conveniently, the forward end of contouring arm 106 is pivotally attached to the upper end of the aft end of vane 10 by a pivot pin 110 and the other end of arm 106 is pivotally mounted on pivot pin 112 which is attached to traveler 114 movable longitudinally within track 116 within upper arm 14. Traveler 114 is normally urged toward the aft end of track 116 by means of coil spring 118 connected between the traveler and the aft end of the track. Thus, the spring 118 tends to keep arm 106 aligned generally parallel over the upper end of sail panels 18. A line 120 for moving traveler 114 along the track has one end attached to the forward end of the traveler and extends over a pulley 122 in mast 12 and then downwardly and around pulley 142, through slot 82 and back to a winch or control motor (not shown) at the helm.

Similarly, lower arm 108 is pivoted at its forward end by means of pivot pin 124 to the lower aft end of vane 10 and the opposite end is pivoted by means of a pivot pin 126 to a traveler 128 which is slidable along track 130. Traveler 128 is normally urged toward the aft end of track 130 by coil spring 132 having one end connected to the aft end of the traveler and the other end connected to the aft end of the track 130. A line 134 has one end connected to the forward end of traveler 128 and extends through a slot 138 in the mast and around a pulley 136 within the mast. The line then extends downwardly through the mast and around a pulley 144 rotatably mounted below pulley 142. The line then extends through slot 82 to the winch or control motor (not shown). Conveniently, both lines 102 and 134 will be controlled simultaneously so that both travelers are moved forwardly at the same time to extend the respective contouring arms 106 and 108 outwardly as best seen in FIG. 9 to force the airfoil to a position having a greater curvature. This extended position of the contouring arms is desirable when the boat is traveling downwind and the mast is turned so that arms 14 and 16 extend generally athwartship so that the sail forms an air scoop to act in somewhat the same manner as a spinnaker.

Figure 14:
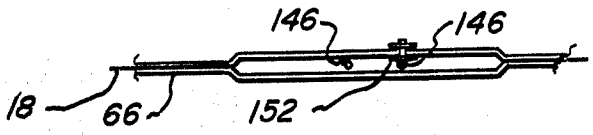
FIG. 14 is an enlarged, horizontal section, taken along line 14—14 of FIG. 13, showing the connection of the halyard to the uppermost batten.
Figure 13:
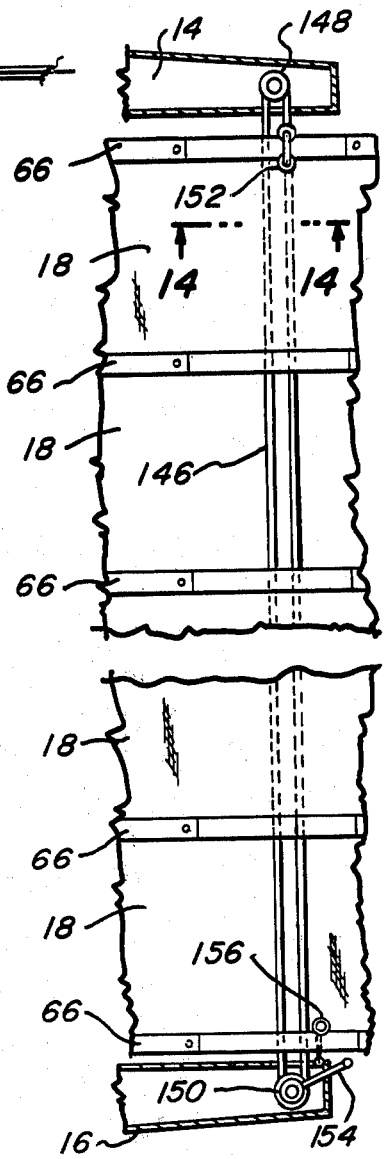
FIG. 13 is a fragmentary vertical section through a portion of the airfoil showing an alternative halyard arrangement wherein the halyard also serves as a positioning cable.

An alternative halyard and downhaul is shown in FIGS. 13 and 14 wherein a halyard 146 is provided as an endless loop extending over an upper pulley 148 and upper arm 14 and a lower pulley 150 and lower arm 16, as shown. The halyard alternates back and forth between adjacent panels 18 much in the same way as positioning cable 20 does in the embodiment of FIG. 3. The halyard includes a hoisting member 152 which engages and is movable along the upper batten 66. A drive means is connected to pulley 150, such as crank 154, so that upon rotating the crank and pulley 150 in one direction, the sail panels will be raised and then upon rotating them in the opposite direction, the sail panels will be lowered to folded position. It will be understood that in some applications, it may be desirable to replace crank 154 with a motor or some remotely located drive means. Clearly, the slots in the battens through which halyard 146 extend permit movement of the sail to different coutours for different sailing conditions. A very short holding cable 156 is provided which is connected between the lower batten 66 and the aft end of arm 16 as shown. The purpose of this holding cable is to keep the lower end of the sail from hiking up when encountering strong winds.

Although only airfoil A has been described in detail, it will be apparent that airfoil A' may be constructed in the same manner. Of course, the size of the respective airfoils may differ as is necessary for the design of the particular boat. Also, the boat may have only one airfoil or it may have more than two, all as will be determined by the size and use of the boat.

Figure 12:
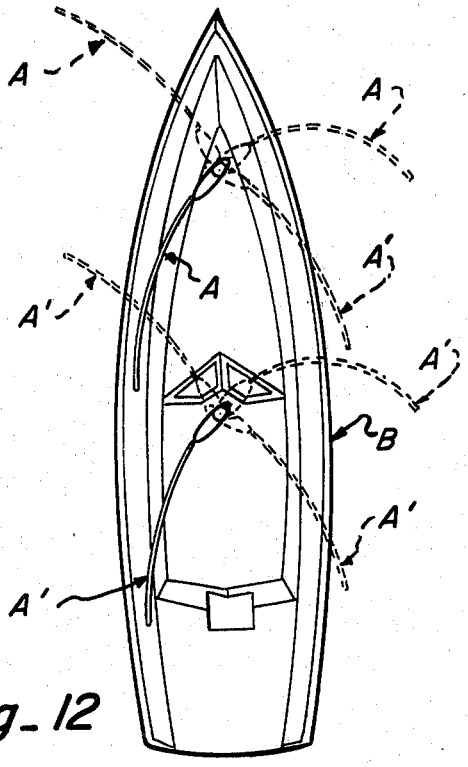
FIG. 12 is a diagramatical top plan view of a boat utilizing the airfoils of this invention showing them positioned in various directions around a 360° arc.

In FIG. 12, the various positions which the airfoils can take are shown. For example, the airfoils A and A' can swing through a full 360° which makes it possible for the ship to actually be driven backwards in the water by the wind. This can be desirable, particularly when maneuvering in harbors and docking areas.

It will be understood that if vane 10 is properly weather sealed, it can serve as a pontoon should the boat capsize to minimize the chance that it will turn clear over. In the unlikely event it was turned clear over by a giant wave, the bouyant vane woud tend to right the boat again. This is of particular importance with a multihulled vessel. Furthermore, the mast can be painted black, the vane can be made of translucent material and an air inlet or scoop provided at the top. The mast then could serve as a solar heater by drawing air with a scoop or blower in the top of the vane and heating it and discharging it into the chain below deck.

Figure 15:
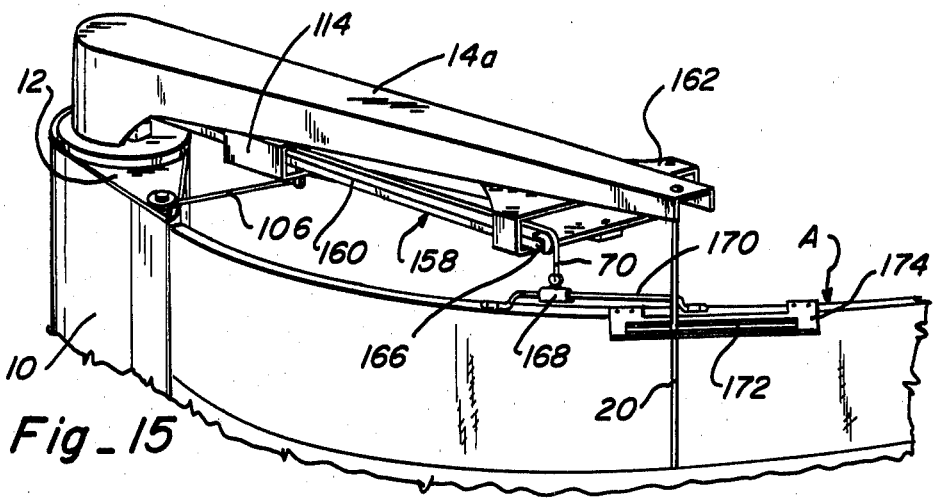
FIG. 15 is an enlarged, fragmentary, perspective view of an alternative upper arm construction.
Figure 16:
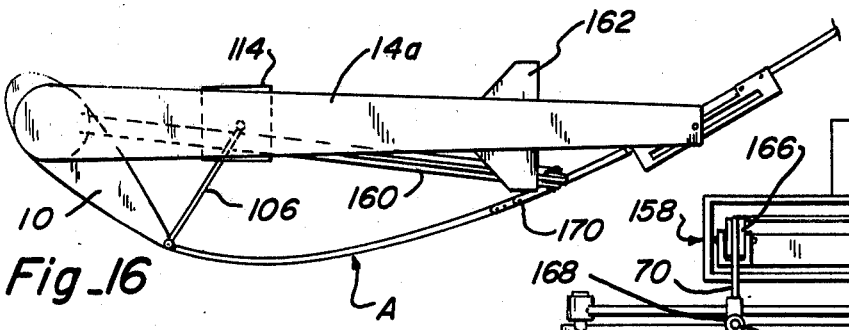
FIG. 16 is a top plan view of the arm of FIG. 15.
Figure 19:
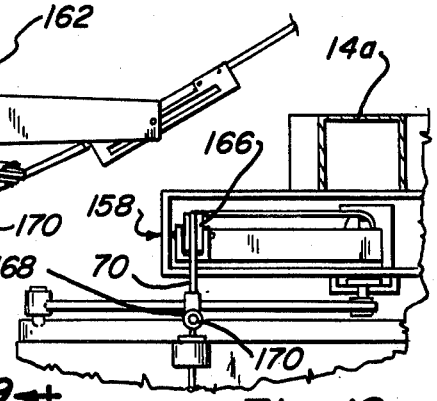
FIG. 19 is an enlarged fragmentary vertical section, taken along line 19—19 of FIG. 17 showing further details of the arm construction.
Figure 17:
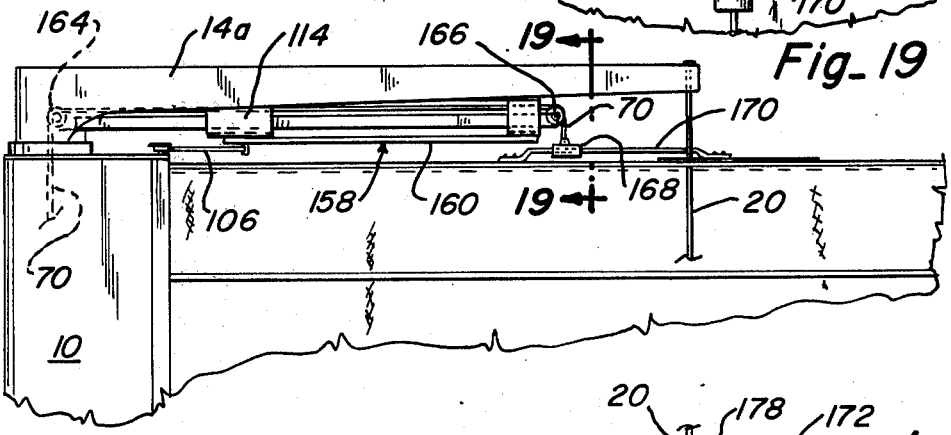
FIG. 17 is a fragmentary, side elevation, of the arm configuration of FIG. 15.
Figure 18:
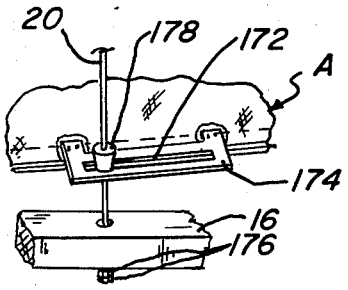
FIG. 18 is a fragmentary, side elevation of the connection for the vertical cable connection to the bottom arm.

An alternative upper arm construction **14*a* is shown in FIGS. 15–17 and 19. In this construction, arm 14*a* is provided with an undercarriage 158 which provides lateral swinging movement of a halyard support arm 160 to permit the halyard to swing beyond the edges of upper arm 14*a*, as best seen in FIGS. 15 and 16. This arrangement allows for better contouring of the airfoil A. The undercarriage 158 includes a support arm 160 pivoted at one end to mast 12 and the other end being slidable across an open support housing 162 attached to arm 14*a* as shown. The halyard 70, as best viewed in FIGS. 15 and 17 extends over a sheave 164 mounted at the mast and then along arm 160 and over a second sheave 166 at the aft end of arm 160. The end of halyard 70 is connected by a sleeve 168 for sliding movement along a rod 170 attached to the upper edge of the airfoil, as shown. As is readily apparent, the halyard can swing laterally on arm 160 beyond the confines of upper arm 14*a* and sleeve 168 may move along rod 170 to allow the airfoil to assume a proper contour. The positioning cable 20, as in the previous embodiment, is attached at one end to upper arm 14*a* and extends through a longitudinal slot 172 in a guide bracket 174. The lower end of positioning cable 20, as best seen in FIG. 8, passes through slot 172 and guide bracket 174 attached to the bottom of the airfoil A and through bottom arm 16 where it is held in place as by two lock nuts 176. Conveniently, a stop 178 is fixedly attached to backstay 30 above guide bracket 174** which prevents the airfoil from rising up due to the pressure of the wind on it.

Traveler 114 is constructed and operates the same as in the previous embodiment wherein it can be moved along rod 160 thereby extending arm 106 to contour the airfoil.

Figure 20:
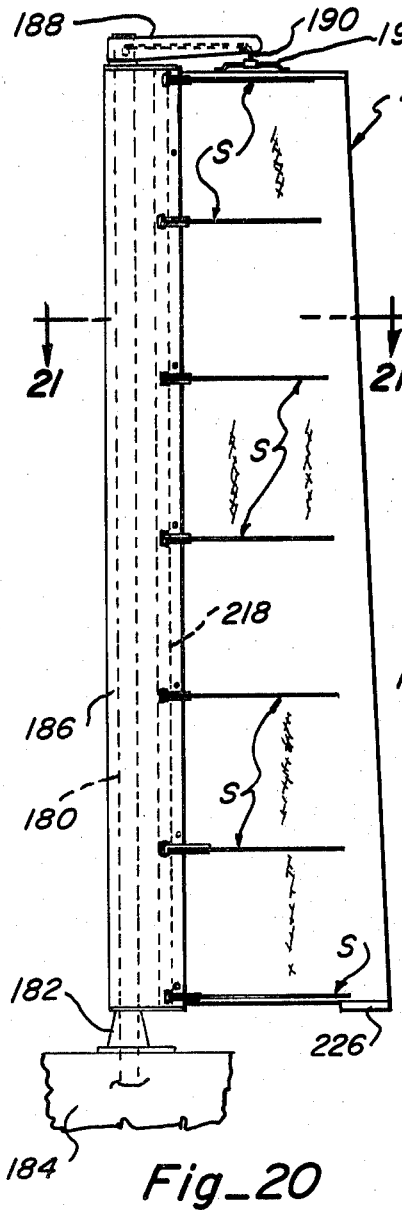
FIG. 20 is a side elevation of an alternative sail arrangement having only an upper arm.

An alternative adjustable airfoil is shown in FIG. 20 wherein the vane has a double luff slot for receiving the luff edges of the battens and sail panels as will be described below. In this embodiment, a mast 180 is rotatably mounted in a stanchion 182 on the deck 184 of a boat. The mechanism for rotating the mast and vane 186 mounted thereon will be described more fully below. A single arm 188 is fixedly attached to the upper end of mast 180 through which a halyard 190 runs. The halyard is connected for movement along a rod 192 attached to the top panel of airfoil A".

Figure 24:
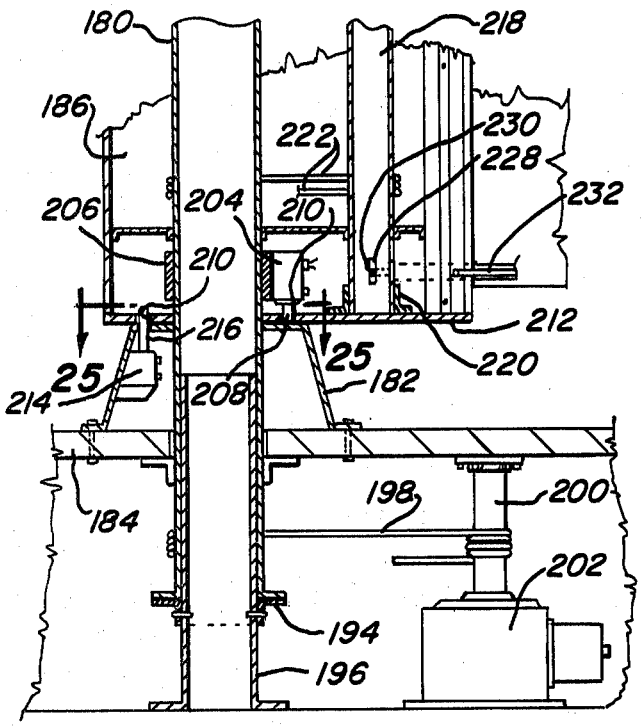
FIG. 24 is an enlarged vertical fragmentary section of the base of the mast and vane of the sail of FIG. 20 showing the drive means and locking solenoids for holding the vane in adjusted position.
Figure 25:
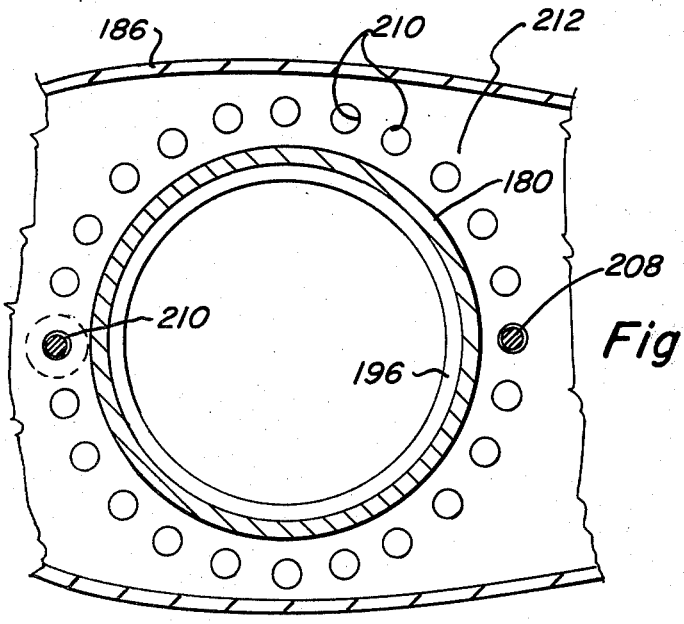
FIG. 25 is an enlarged fragmentary horizontal section, taken along line 25—25 of FIG. 24, showing how the solenoids lock the vane in adjusted position with respect to the mast and the base.

As best seen in FIG. 24, mast 180 is supported on a flange 194 attached to mast axle 196 below deck 184. A drive means such as a cable 198 is looped around the lower end of mast 180 and extends to a drive shaft 200 around which the other end is looped which is driven in either direction by a reversable motor 202. Conveniently, mast 180 may be fixedly secured to vane 186 by means of solenoid 204. The solenoid is fixedly connected to the mast by means of a collar or ring 206 and has a retractable pin 208 which can selectively extend into any one of a plurality of openings or holes 210 in a bottomplate 212 of the vane. Furthermore, the vane can be selectively connected to stanchion 182 and the deck of the boat by means of a second solenoid 214 attached to the stanchion and having a pin 216 which is also extendable through one of the openings 210 in base 212 of the vane. The purpose for this arrangement will be explained more fully below.

Parallel to mast 180 and within vane 186 toward the luff edge is a rotatable shaft 218 which is supported for rotation in a base 220 on plate 212 as seen in FIG. 24. Several drive cables 222 extend between and are wrapped around both mast 186 and shaft 218 so that when the vane is fixed relative to the hull, by means of solenoid 214, and the mast is rotated in one direction, the shaft is rotated in the opposite direction. By means of this mechanism and rotation of shaft 218, a shackle S can be manipulated as best seen in FIGS. 21A–21D to control the contour of the airfoil A" as more fully explained below.

With the arrangement just described, it is unnecessary to utilize a positioning cable or the travelers for extending and contouring the sail. The leech edge of the sail has a weight 226 attached to the lower end thereof and that, together with the forces exerted by the shackles S on the sail as it is contoured, tend to hold the leech corner of the sail down.

Returning now to FIG. 24, it will be understood that the angle of the airfoil with respect to the direction of the boat will be controlled by rotating the mast and the vane together with solenoid 204 in the locked position and when the desired position of the airfoil is reached, the locking solenoid 214 is engaged so that the vane cannot rotate with respect to the stanchion 182 and therefore with respect to the boat.

Figure 21A:
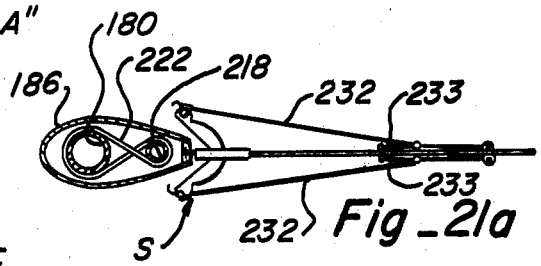
FIGS. 21A, 21B, 21C, and 21D are each enlarged horizontal sections, taken along line 21—21 of FIG. 20, showing various contours of the sail of FIG. 20.
Figure 21B:
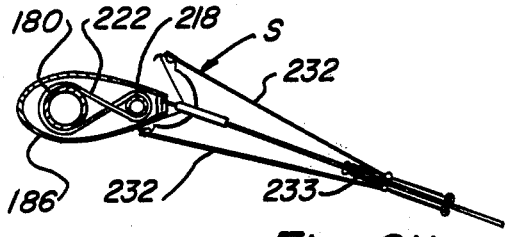
Figure 21C:
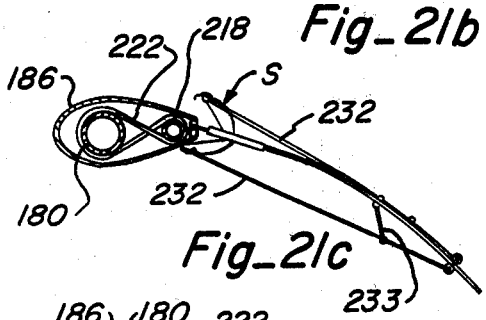
Figure 21D:
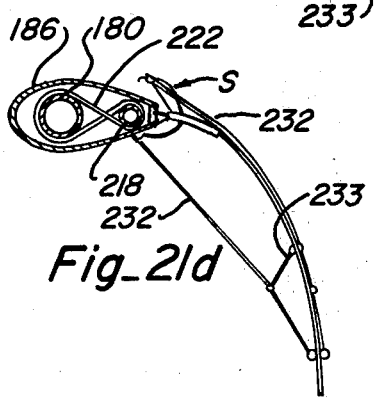
Figure 22:
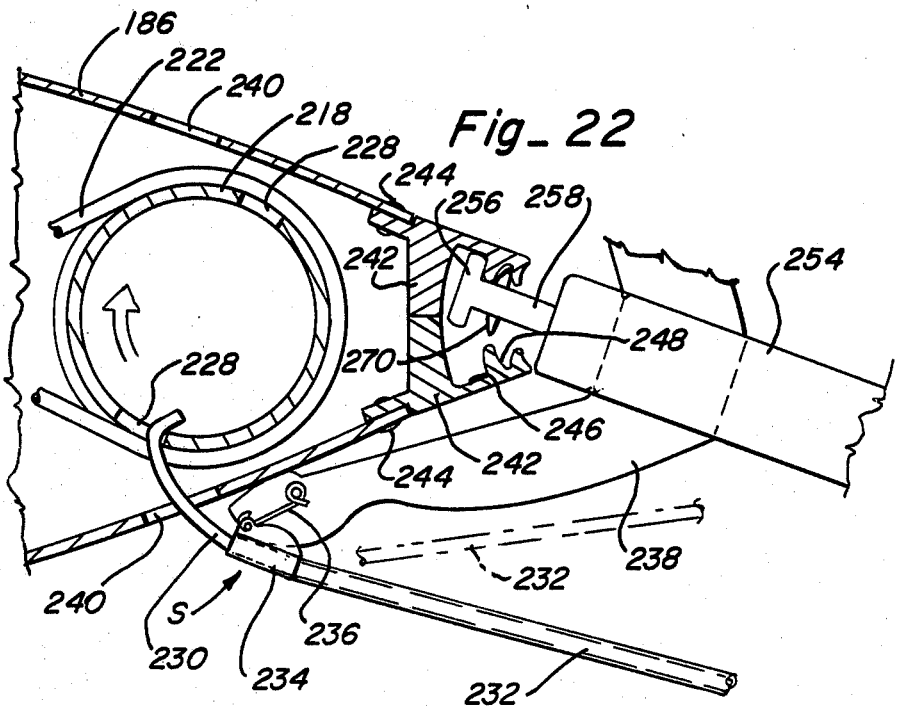
FIG. 22 is an enlarged fragmentary view of the luff connection between the vane and sail of the sail of FIG. 20.
Figure 23:
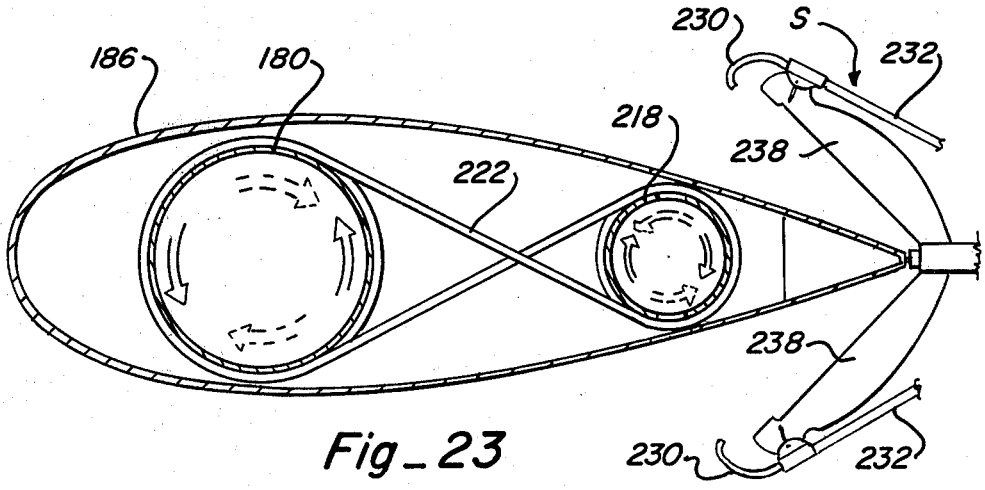
FIG. 23 is an enlarged fragmentary view of the vane and cable connectors for the sail of FIG. 20.

In order to contour the sail, solenoid 214 is locked after the vane has been rotated to position it relative to the rest of the airfoil as shown in FIGS. 21B and 22. Thereupon, solenoid 204 is released and upon continued rotation of the mast, shaft 218 rotates. Conveniently, shaft 218 is provided with slots or notches 228 for engagement by hooks 230 on shackles S. These hooks are connected to cables 232 and connected by means of a bracket through a spring 236 to a shackle arm 238. As is apparent from FIGS. 21A–21D, the elements just described are provided in pairs on opposite sides of the sail so that the airfoil can be contoured in either direction. Only one direction will be described, but it will be understood that the rotation of all of the elements in the opposite direction will accomplish a contour in the opposite direction.

As can be seen, as shaft 218 is rotated in a clockwise direction as illustrated in FIG. 22, hook 230 will be pulled inwardly through a slot 240 in the vane causing the effective length of cable 232 to be shortened. The opposite end of the cable is attached to the batten adjacent its leech edge as shown in FIG. 20 and FIGS. 21A–21D. Conveniently, a cord 233 is connected between the sail and the cable intermediate its ends to provide a contouring force near the center of the sail, as indicated. Thus, the sail will be contoured depending on the amount of rotation of shaft 218 to the position shown in FIGS. 21C and 21D. Clearly, virtually any amount of contour can be created by this mechanism. Thus, when sailing into the wind, the airfoil contour may be kept relatively flat whereas when sailing downwind, the contour may be curved to a substantially greater extent to more nearly approach the contour of a conventional spinnaker.

Figures 26, 27, 28, 29:
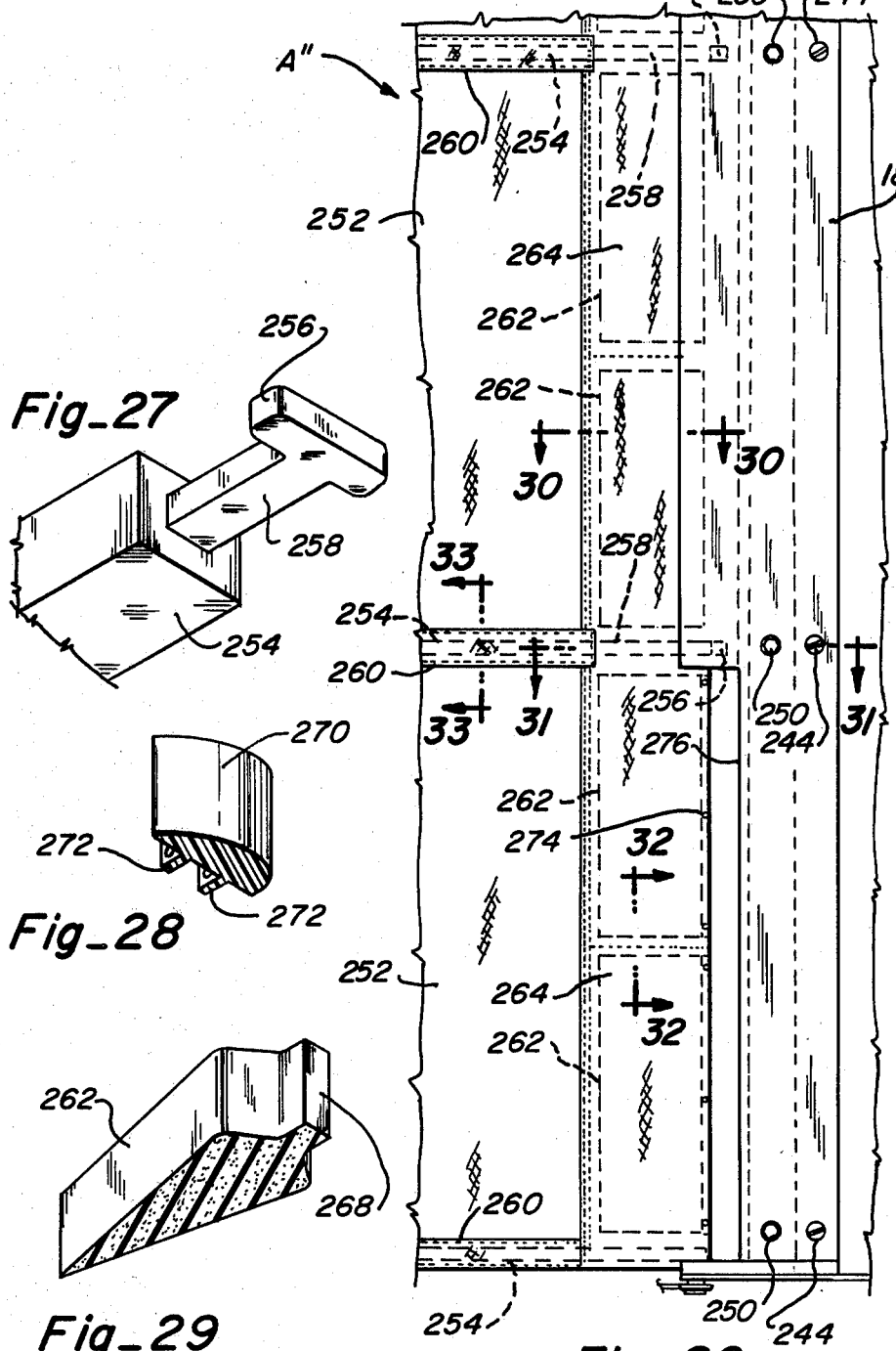
FIG. 26 is an enlarged fragmentary side elevation of the sail of FIG. 20 showing details of construction thereof.
FIG. 27 is an enlarged fragmentary perspective of the locked end of a batten used in the sail.
FIG. 28 is an enlarged perspective view of the luff end of the sail.
FIG. 29 is an enlarged perspective view of an insert in the sail adjacent the luff edge.
Figure 30A:
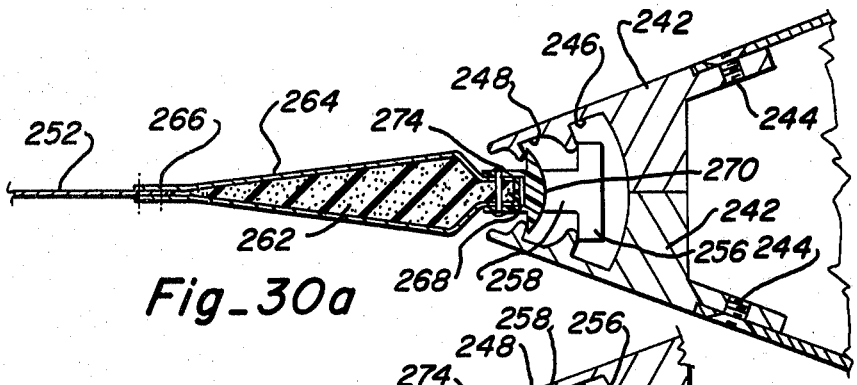
FIGS. 30A and 30B are fragmentary enlarged horizontal sections taken along line 30—30 of FIG. 26 showing details of the luff connection of the sail and battens to the vane.
Figure 30B:
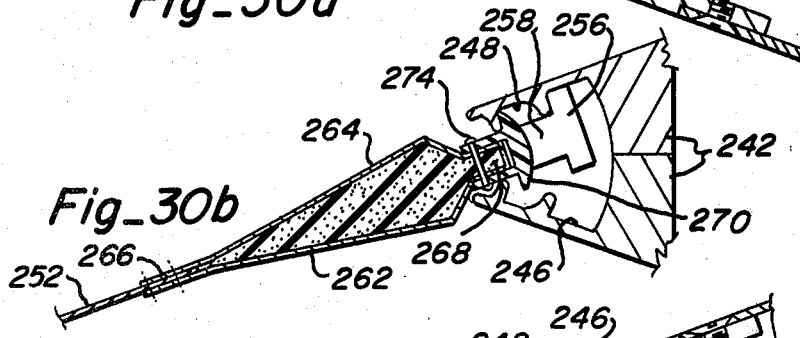
Figure 31:
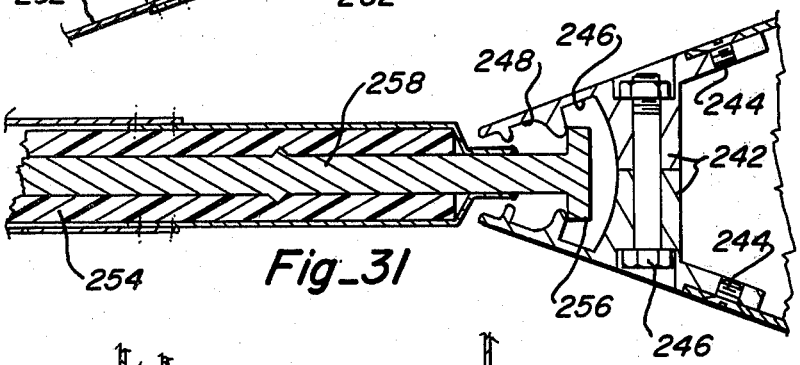
FIG. 31 is an enlarged fragmentary horizontal section taken along line 31—31 of FIG. 26, showing details of the batten constructions.
Figure 32:
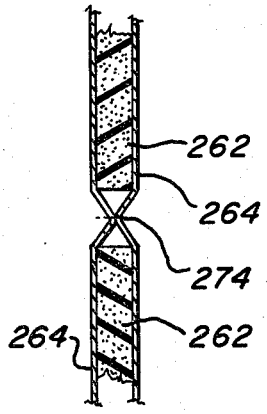
FIG. 32 is an enlarged fragmentary vertical section, taken along line 32—32 of FIG. 26 showing the fold line between inserts of the sail.
Figure 33:
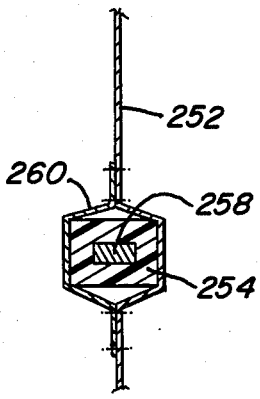
FIG. 33 is an enlarged fragmentary vertical section, taken along line 33—33 of FIG. 26 showing further details of the construction of the batten and how it is positioned in the sail.

A double luff slot arrangement is provided at the aft edge of the vane which is an important part of this invention. As best seen in FIGS. 22, 30A and 30B, and 31, the luff slot is made from two luff extrusions 242 which are joined to the vane, as by bolts or rivets 244. As can be seen, when assembled, they form a forward luff slot 246 for receiving the end of a batten and a rear luff slot 248 for receiving the luff edge of a sail. With this arrangement, it is unnecessary to have a luff slot flap as in the embodiment described in connection with FIG. 11. These extrusions are held together by transverse bolts 250 best seen in FIGS. 26 and 31. As seen in 26, the airfoil A" is made up of sail panels 252 attached to vertically spaced battens 254 having forward ends 256 received in the forward luff slot 246 and connected to the body of the batten by a neck 258. Conveniently, the batten 254 is received in a pocket in the sail panels formed by a strip 260 sewed above and below the batten as shown in FIG. 33. The luff edge of the sail panels between the battens are provided with inserts 262 which are sewed into pockets formed by a vertical strip 264 folded back upon itself and sewed to the forward edge of the sail panel 252, as by stitching 266. This is best seen in FIGS. 30A and 20B. Insert 262 has a forwardly extending neck 268 which is adapted to receive sail panel luff flange 270, best shown in FIG. 28, which has a pair of speced rearwardly depending legs which are received over neck 268 and strip 264 as shown in FIGS. 30A and 30B and held in place as by a transverse pivot 274. Conveniently, a longitudinal row of stitching 275 is provided between vertically spaced inserts 262 to form a fold line so that upon lowering the sail, it will fold in accordion fashion. To accomodate the folding of the sail, the lower end of vane 186 has a recess 276 formed therein so that upon releasing of the halyard, the lowered sail will fold flat on the deck of the boat. It will be understood that recess 276 is cut back past aft luff slot 248, but not as far as forward luff slot 246. Thus, the sail panel flanges 270 come out of the luff slot as the sail is lowered whereas the batten ends 256 are retained in and ride along forward luff slot 246.

From the foregoing, it can be seen that an alternative airfoil construction has been provided wherein the sail can be contoured without the necessity of a positioning cable, and the use of a luff slot flap is avoided. Conveniently, by use of the shackle arrangement previously described, the sail can be contoured to almost any desired airfoil shape and, with the double luff slot arrangement, provide a continuous airfoil, one which is relatively economical in construction and simple in operation.

It will be understood to one skilled in the art that although the invention has been illustrated and described for use with respect to sail boats, that it can be used for windmills, hang gliders, propellers, or any other device requiring an airfoil.

The invention has been described in detail with particular reference to preferred embodiments therefore, but it will be understood that variations and modifications can be effected within the spirit and scope of the invention.

I claim:

1. An adjustable airfoil comprising:

a free-standing mast which is rotatable about an axis generally perpendicular to a support surface on which said mast is to be mounted, said mast having an upper end and a lower end;

at least a first arm fixedly attached to said upper end of said mast and extending perpendicular from said mast and a second arm fixedly attached to said mast below said upper arm and relatively adjacent to said lower end of said mast and extending perpendicular from said mast;

a vane rotatably mounted on said mast between said arms, said vane having luff slot means along an aft edge of said vane;

a sail made up of a plurality of articulated panels attached together for folding in accordion fashion with means at the forward end of each panel slidably mounted in said luff slot means;

halyard means for raising and lowering said sail panels so that when in raised position, said panels form a substantially planar airfoil and when lowered, said panels are folded in accordion fashion on the deck; and control means for selectively rotating the mast and the vane as required under different air conditions.

2. An airfoil, as claimed in claim 1, wherein:

said control means rotates said mast and said vane independently of each other.

3. An airfoil, as claimed in claim 1, wherein said slidably mounted means include:

a batten attached along each edge of each panel and having a first end which is enlarged and slides up and down within the luff slot and an aft end which extends substantially to the leech edge of the sail.

4. An airfoil, as claimed in claim 3, further including:

a positioning cable extending between the aft end of said arms; and openings in each batten aligned with said cable, said cable being threaded through said openings so that it extends along opposite sides of adjacent panels.

5. An airfoil, as claimed in claim 4, wherein:

said positioning cable is located closer to the leech edge of said sail than to the luff edge.

6. An airfoil, as claimed in claim 5, wherein, said halyard means comprises:

a first sheeve mounted within said mast at said upper arm;

a second sheeve mounted in said upper arm forwardly of said backstay;

a line extending through said mast from a point near the deck of the boat, over said first sheeve, along and within said upper arm, over said second sheeve and having an end connected to the upper edge of said sail.

7. An airfoil, as claimed in claim 6, wherein:

said second sheeve is mounted on and slidable along a shaft extending transversely across said upper arm.

8. An airfoil, as claimed in claim 3, wherein each sail panel includes:

a pair of hinged planar members attached to each panel adajcent the luff edge to cause said panels to fold in accordion fashion when said sail is lowered.

9. An airfoil, as claimed in claim 8, wherein:

said plannar hinged members are made of plastic foam material.

10. An airfoil, as claimed in claim 8, further including:

a flap attached along each side of the aft edge of said vane and extending across the forward portion of said sail panels to provide a continuous, smooth surface for laminar air flow.

11. An airfoil, as claimed in claim 10, wherein said flap includes:

means pivoting each of said flaps to said vane; and spring means normally holding each of said vanes against the side surface of said vane, but being movable away from said vane surface in response to movement of said sail panels.

12. An adjustable airfoil said comprising:

a free-standing mast which is rotatable about an axis generally perpendicular to a support surface on which said mast is to be mounted, said mast having an upper end and a lower end;

first and second generally parallel, spaced arms, said first arm being fixedly attached to said upper end of said mast and extending perpendicular from said mast, said second arm being fixedly attached adjacent said lower end of said mast on the same side of said mast as said first arm;

a vane rotatably mounted on said mast between said arms, said vane having a luff slot along an aft edge extending between said arms;

a sail made up of a plurality of articulated panels attached together for folding in accordion fashion with means at the forward end of each panel slidably mounted in said luff slot;

halyard means for raising and lowering said sail panels so that when in raised position, said panels form a substantially planar airfoil and when lowered, said panels are folded in accordion fashion on the deck; and control means for selectively rotating the mast and the vane as required under different sailing conditions.

13. An airfoil, as claimed in claim 12, wherein said halyard means comprises:

a first pulley rotatably mounted adjacent the aft end of said upper arm;

a second pulley rotatably mounted adjacent the aft end of said lower arm below said first pulley;

drive means connected to said second pulley for rotating it selectively in opposite directions;

a halyard in the form of an endless loop extending around said pulleys;

openings in each batten aligned with each reach of the halyard, each reach being threaded through said openings so that each reach extends along opposite sides of adjacent panels; and means attaching one reach of said halyard to the top of the uppermost panels for raising said panels when said halyard is moved in one direction by rotating said second pulley and to lower said panels when said halyard is moved in the opposite direction by rotating said second pulley.

14. An Airfoil, as claimed in claim 13, further including:

a downhaul connected to the bottommost panel to hold the lower edge of the airfoil in position adjacent said lower arm when the panels are raised by the halyard.

15. An airfoil, as claimed in claim 14, wherein said downhaul comprises:

means on the other reach of said halyard engagable with said lowermost panel only when said panels are in raised position to hold the lowermost panel adjacent said lower arm.

16. An airfoil, as claimed in claim 12, wherein said control means includes:

upper and lower contouring rods having one end pivotally connected respectively to the upper and lower end of said vane adjacent the aft end;

a longitudinal track of each of said arms;

a traveler slidably mounted in each of said tracks and spring biased toward the aft end, the other end of said rods being pivotally connected to said travelers in said respective upper and lower arms; and means for moving said travelers forward against said spring bias to swing said arms laterally of said arms to increase the contour of said sail panels.

17. An adjustable airfoil comprising:

a free-standing mast which is rotatable about an axis generally perpendicular to a support member on which said mast is to be mounted, said mast having an upper end and a lower end;

a first arm fixedly attached to said upper end of said mast and extending perpendicular from said mast;

a vane rotatably mounted on said mast below said arm, said vane having a double luff slot along an aft edge of said vane comprising a first forward luff slot and a second aft luff slot parallel to said first luff slot;

a sail made up of a plurality of articulated panels attached together for folding in accordion fashion;

a batten attached along each edge of each panel and having a first end which is enlarged and slides up and down within said forward luff slot and an aft end which extends toward the leech edge of the sail;

a flange on the luff edge of the sail which engages and is slidable up and down within said aft luff slot;

halyard means for raising and lowering said sail panels so that when in raised position, said panels form a substantially planar airfoil and when lowered, said panels are folded in accordion fashion on the deck; and control means for selectively rotating the mast and the vane as required under different sailing conditions.

18. An airfoil, as claimed in claim 17, further including:

a plurality of shackles vertically spaced along said airfoil; and means within said vane engagable with said shackles to selectively contour said airfoil.

19. An airfoil, as claimed in claim 18, wherein: said shackles each further include:

a pair of shackle arms extending from opposite sides of said batten just aft of said vane;

a hook pivotally connected to the outer end of each of said shackle arms and positioned for forward pivotal movement;

a cable having one end connected to each hook and an opposite end connected to said batten adjacent the leach edge thereof; and said engagable means further includes:

means for selectively engaging all of the hooks on one side of said batten or the other and pulling the hooks and connected cables forward to effectively foreshorten those cables and change the contour of the airfoil.

20. An airfoil, as claimed in claim 19, wherein said engagable means includes:

a rotatable shaft mounted within said vane adjacent said luff slots and parallel to said mast;

a single row of hook-receiving openings spaced along said shaft and aligned with said hooks;

a plurality of slots on each side of said vane corresponding in number and location to said hook; and drive means connecting said mast to said shaft so that upon rotation of said mast in one direction, said shaft is rotated in the opposite direction so that upon manipulation of said control means, said vane is pivoted to cause the hooks on one side to extend through said slots and into said openings, said shaft can be rotated to pull said hooks and their respective cables forward to change the contour of said airfoil.

21. An airfoil, as claimed in claim 17, wherein said control means includes:

a first releasable lock means for interconnecting said mast and said vane for rotation together; and a second releasable means for locking said vane in fixed angular positions with respect to the support member.

* * * * *